United States Patent [19]

Westfall

[11] 4,274,544

[45] Jun. 23, 1981

[54] SINGLE-PIECE PLASTIC CLOSURE HAVING INTEGRAL SEAL FORMING MEANS

[75] Inventor: James E. Westfall, Western Springs, Ill.

[73] Assignee: The Continental Group, Inc., Stamford, Conn.

[21] Appl. No.: 129,443

[22] Filed: Mar. 11, 1980

[51] Int. Cl.[3] ..... B65D 53/00

[52] U.S. Cl. ..... 215/344; 215/341

[58] Field of Search ..... 215/343, 344, DIG. 1, 215/329, 341, 320, 321, 345, 354; 220/288

[56] References Cited

U.S. PATENT DOCUMENTS

| | | | |
|---|---|---|---|
| 3,272,369 | 9/1966 | Grimshey | 215/341 X |
| 3,281,000 | 10/1966 | Lowen | 215/DIG. 1 |
| 4,209,102 | 6/1980 | Dunn et al. | 215/344 X |

*Primary Examiner*—George T. Hall

*Attorney, Agent, or Firm*—Charles E. Brown

[57] ABSTRACT

A closure cap for containers of the bottle and jar type wherein the closure cap is formed in one piece of plastics material and is formed with an integral sealing strip which is directly engageable with the terminal sealing surface of a container automatically to form a continuous seal therewith.

16 Claims, 14 Drawing Figures

(a)
(b)
(c)

SINGLE-PIECE PLASTIC CLOSURE HAVING INTEGRAL SEAL FORMING MEANS

This invention relates in general to new and useful improvements in containers, and more specifically to a closure cap for containers of the jar and bottle type.

This invention most particularly relates to a closure cap which is formed of a plastic material and which closure cap, when applied, will directly form a seal with the terminal sealing surface of an associated container. Most specifically, the plastic material closure cap is provided with an integral sealing strip which is deformable when applied so as to mate with and form a continuous seal with the terminal sealing surface of a container.

In accordance with this invention, the closure cap includes a skirt portion having retaining means, generally in the form of threads, which are engageable with the exterior neck finish of a container and arranged in interlocked relation so as to hold the skirt portion in a preselected axial position.

The closure cap also includes an end panel which is integrally formed with the skirt and the end panel is generally in the form of a central panel portion which is joined to the top of the skirt portion by an intermediate annular sealing strip. The sealing strip has sufficient flexibility so as to engage, under tension, the terminal sealing surface of an associated container and directly form a seal therewith.

In accordance with this invention, the sealing strip is deformable by engagement with a container terminal sealing surface and is sufficiently flexible so as to accommodate terminal sealing surfaces which may be generally irregular, and particularly those sealing surfaces which lie in a plane which is tilted from a position normal to the axis of the container.

In accordance with this invention, the sealing strip is relatively thin, particularly with reference to the skirt, and has a sealing surface which is spaced radially inwardly from the skirt with there being a transition portion between that part of the sealing strip defining the sealing surface and the skirt such that when the skirt is drawn down on the neck of the container, the sealing strip will automatically be deformed in a manner progressively to conform to the configuration of the terminal sealing surface progressively in a radial direction.

The closure cap may be used both with products which are packed at ambient pressure and those which are packed at subatmospheric pressure. Further, the end panel of the closure cap has a thickened central panel portion which is reacted upon by pressure differential in the case of a vacuum pack so as further progressively to draw the sealing strip down and around the container terminal sealing surface.

The sealing strip may be formed of different cross sections including a frustoconical configuration and bowed configurations, the bow being selectively axially inward or outward.

With the above and other objects in view that will hereinafter appear, the nature of the invention will be more clearly understood by reference to the following detailed description, the appended claims, and the several views illustrated in the accompanying drawings.

IN THE DRAWINGS

FIGS. 12*a*, 12*b* and 12*c* are sectional views showing other neck finishes or terminal sealing surfaces with which the closure caps are usable.

Figure 1:
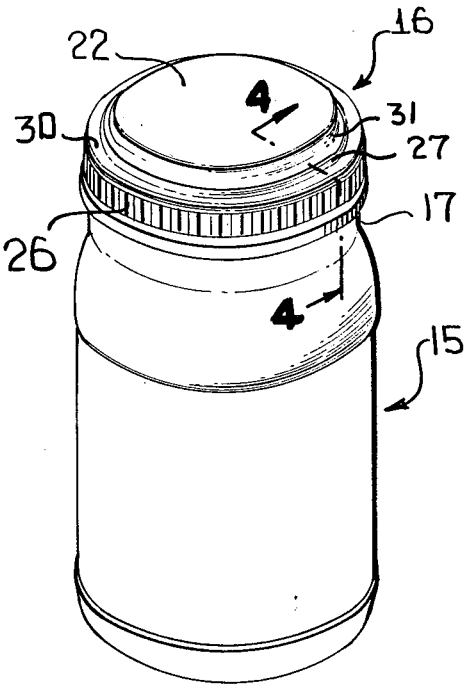
FIG. 1 is a perspective view of a container which is closed utilizing a closure cap formed in accordance with this invention.
Figure 2:
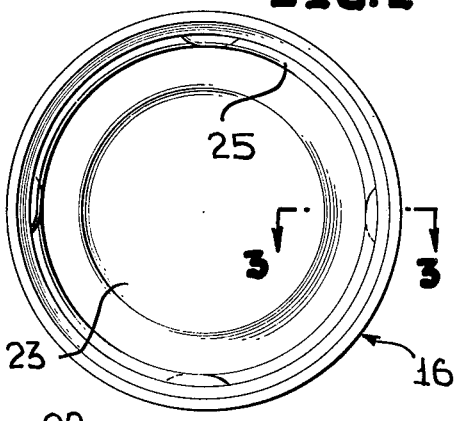
FIG. 2 is an enlarged bottom view of the closure cap per se of FIG. 1.

Referring now to FIG. 1 in particular, it will be seen that there is illustrated a conventional container, generally identified by the numeral 15, which is sealed by way of a closure cap, generally identified by the numeral 16, formed in accordance with this invention. The closure cap 16 is applied to a neck finish 17 of the container 15. The illustrated container is formed of glass, but may be formed of materials such as plastic, metal, and other conventional container materials.

In accordance with this invention, the neck finish is provided with a retaining element 18 beneath which retaining means the closure cap 16 may be engaged for the purpose of drawing the closure cap down onto the neck finish 17 in a tensioned condition as will be described hereinafter. The retaining element 18 in the illustrated embodiment of the invention is in the form of an interrupted thread or lug, but could be in the form of a continuous thread or even a locking rib or shoulder.

Figure 4:
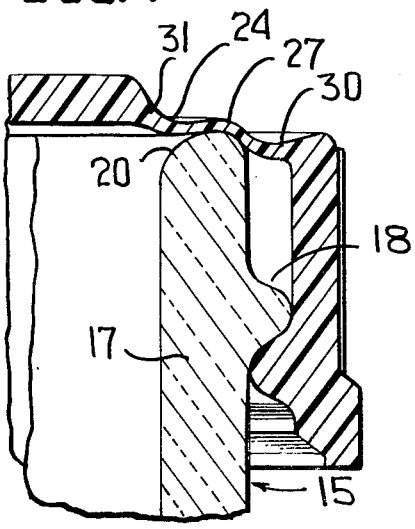
FIG. 4 is an enlarged fragmentary sectional view taken generally along the line 4—4 of FIG. 1, and shows the applied relationship of the closure cap to the container when the container is packed at ambient pressure.

The container 15 has a terminal sealing surface 20 which is generally rounded, as is clearly shown in FIG. 4. It is to be understood that the container 15 is a conventional container and in and of itself does not form a part of this invention.

The closure cap is of a one-piece construction and is preferably formed of a plastics material with a high density polyethylene and polypropylene being at the present preferred materials although the invention is not so limited. The closure cap includes a skirt 21 and an end panel 22. The end panel 22 includes a central panel portion 23 and an annular sealing strip 24, the annular sealing strip 24 connecting the radially outer surface of the central panel portion 23 to the extreme top of the skirt 21.

The skirt 21 is provided with internally projecting retaining means 25 which are illustrated as being in the form of interrupted threads. The outer surface of the skirt 21 is vertically knurled as at 26 to facilitate gripping.

Figure 3:
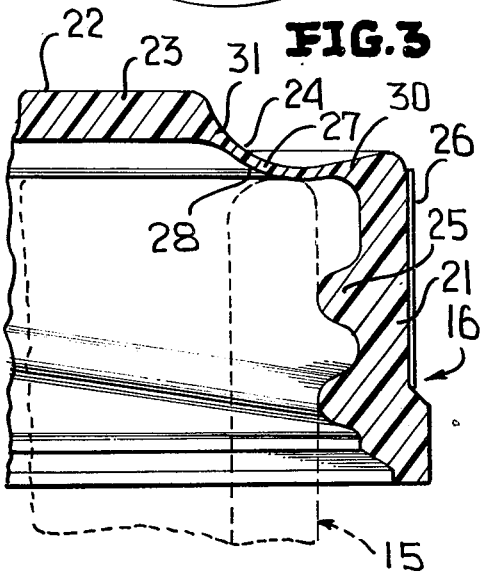
FIG. 3 is an enlarged fragmentary vertical sectional view taken generally along the line 3—3 of FIG. 2, and shows a fragmentary cross section through the closure cap.

The central panel portion 23 is of a thickness comparable to the wall of the skirt 21, as will be apparent from FIG. 3. On the other hand, the sealing strip 24 is comparatively very thin.

The sealing strip 24 may be broadly divided into a central or intermediate sealing portion 27 which is generally of a constant thickness and defines on the inner surface thereof a sealing surface 28. The intermediate sealing portion 27 is integrally connected to the extreme top of the skirt 21 by a transition portion 30 which increases in thickness radially outwardly from the sealing portion 27. In a like manner, the sealing portion 27 is joined to the central panel portion 23 by a transition portion 31 which increases in thickness radially from the sealing portion 27 toward the central panel portion 23. It is further to be noted that the transition portion 31 is joined to the central panel portion 23 along the lower portion of the central panel portion.

Figure 5:
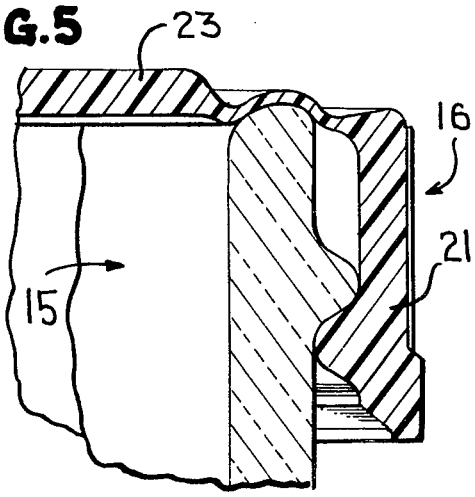
FIG. 5 is a sectional view similar to FIG. 4, but shows the container packed at subatmospheric pressure.

In the illustrated embodiment of the closure cap 16 of FIGS. 3–5, the sealing strip 24 is arcuate in cross section and bows axially downwardly or inwardly and radially inwardly. It is further to be noted that the sealing portion 27 is aligned with the sealing surface 20 of the container 15 and is spaced further from the skirt 21 than from the central panel portion 23.

When the closure cap is drawn downwardly on the neck finish 17, such as by interengagement of the threads 25 with the threads or lugs 18, the sealing surface 28 initially engages the sealing surface 20 as shown in FIG. 3, and then as the skirt 21 continues to move downwardly on the neck finish 17, due to the stiffness of the transition portion 30, the sealing portion 27 is deformed axially outwardly or upwardly by its engagement with the radially outer portion of the sealing surface 20. It is to be understood that the increasing resistance of the transition portion 30 in a radially outward direction causes a deformation of the sealing portion 27 to engage progressively both radially inwardly and radially outwardly around the sealing surface 20.

In FIG. 4, the container 15 is packed at ambient pressure. When so utilized, it is not necessary that the central panel portion 23 be as thick as illustrated. As is apparent from the view, the tendency is for the sealing strip 24 merely to extend horizontally from the highest point of the sealing surface 20. On the other hand, as described hereinafter, the thick central panel portion 23 does have a purpose.

Referring now to FIG. 5, it will be seen that there is illustrated the same closure cap 16 applied to the same container 15 in the same manner as illustrated in FIG. 4, but wherein the container is vacuum packed or packed at a subatmospheric pressure. The net result is that the pressure differential on the central panel portion 23 moves the central panel portion 23 downwardly into the interior of the neck finish or mouth of the container 15, drawing the radially inner part of the sealing portion 27 down and around the radially inner portion of the terminal sealing surface of the container. Thus, the extent of the seal between the closure cap 16 and the container 15 is increased.

At this time it is pointed out that the sealing strip 24 is sufficiently flexible that it will accommodate minor deformations in the terminal sealing surface 20. Further, when the terminal sealing surface 20 lies in a plane which is not normal to the axis of the container 15, there can be more deformation of one part of the sealing strip 24 than that diametrically opposite the same so as to compensate for this tilt in the terminal sealing surface 20.

Figures 6, 7, 8, 9, 10, 11, 12:
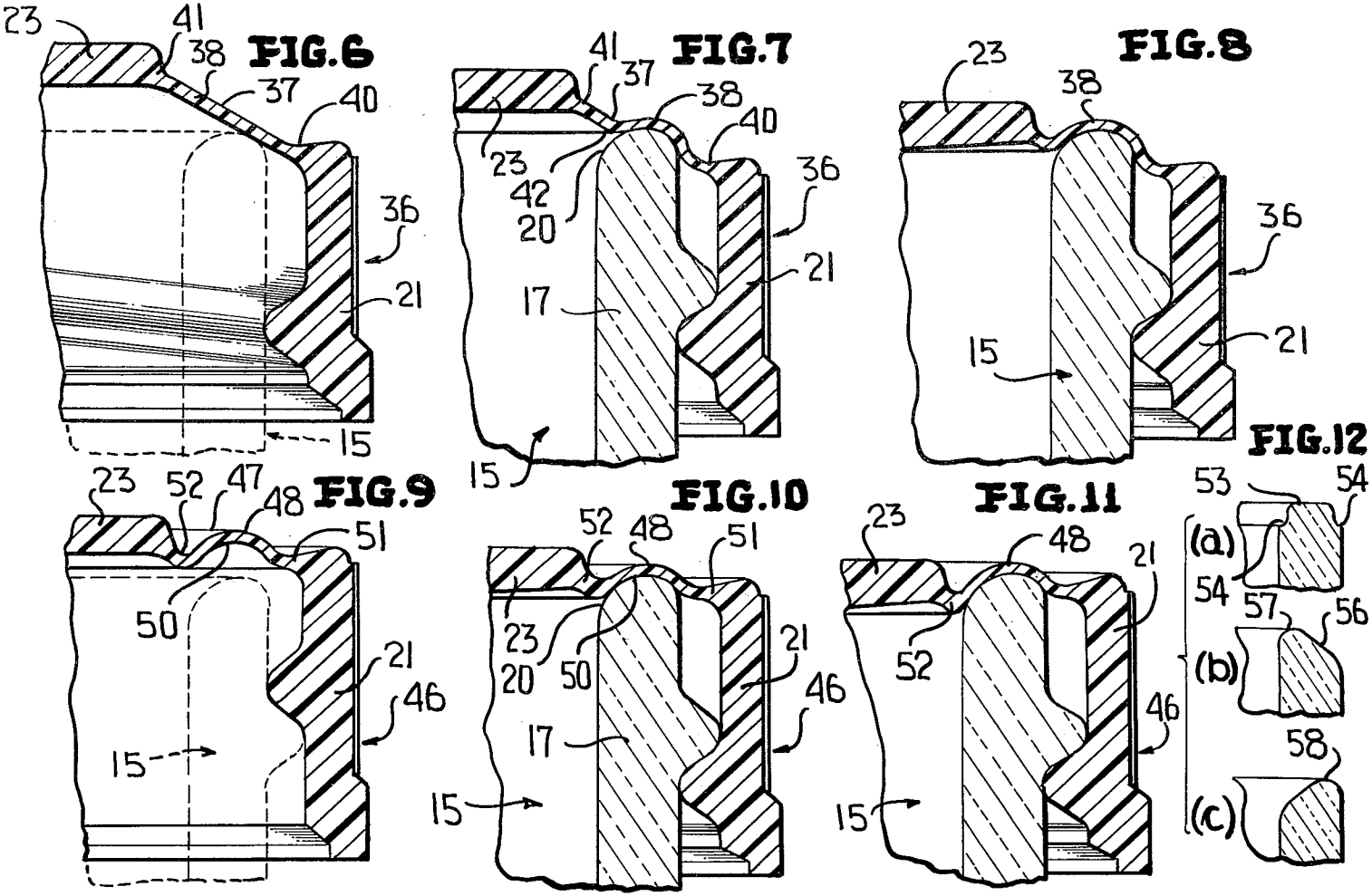
FIGS. 6, 7 and 8 are sectional views corresponding to FIGS. 3, 4 and 5, respectively, but relate to a modified form of closure cap.
FIGS. 9, 10 and 11 are sectional views corresponding to FIGS. 3, 4 and 5, respectively, but illustrate still another form of closure cap.

Reference is now made to the closure cap shown in FIG. 6, which closure cap is generally identified by the numeral 36 and is identical with the closure cap 16 except for the sealing strip 37 thereof. The sealing strip 37, instead of being downwardly and radially inwardly bowed in its initial configuration, is frustoconical and slopes upwardly and radially inwardly as is clearly shown in FIG. 6.

The sealing strip 37, like the sealing strip 24, includes an intermediate sealing portion 38 which is joined to the extreme top of the skirt 21 by a transition portion 40 which corresponds to the transition portion 30. In a like manner, the sealing portion 38 is joined to the relatively thick central panel portion 23 by a transition portion 41 which corresponds to the transition portion 31.

As is shown in FIG. 7, the closure cap 36 is applied to the container neck finish 17 in the same manner described with respect to the closure cap 16 and the sealing strip 37 is upwardly and radially outwardly deformed so that an inner sealing surface 42 of the sealing portion 38 conforms to the terminal sealing surface 20 of the container 15. It is to be noted that the sealing portion 38 wraps around the terminal sealing surface 20 both radially inwardly and outwardly below the point of maximum height of the sealing surface 20. This is due to the increased rigidity of the transition portions 40, 41. It is also to be noted that the central panel portion 23 has moved downwardly or axially inwardly with respect to the skirt 21.

It is to be understood that the closure cap 36, as applied to the container 15, is at equalized pressures in that the container 15 is packed at ambient pressure. On the other hand, with reference to FIG. 8, it will be seen that the same closure cap 36 as applied to the same container 15 has the central panel portion 23 drawn axially downwardly generally into the neck finish or mouth of the container 15 with the result that the sealing portion 38 is further drawn down and radially inwardly around more of the terminal sealing surface 20. At the same time, the central panel portion 23 has moved downwardly considerably with respect to the skirt 26 as referenced by a comparison of FIGS. 6 and 8.

Referring now to FIGS. 9, 10 and 11, there is illustrated still another form of closure cap in accordance with this invention, the closure cap being generally identified by the numeral 46. The closure cap 46 includes the skirt 21 and the central panel portion 23. The central panel portion 23 is joined to the extreme top of the skirt 21 by a sealing strip 47. The sealing strip 47 includes an intermediate sealing portion 48 which is aligned with the terminal sealing surface 20 of the container 15 and has an inner sealing surface 50 engageable therewith in sealed relation. The sealing portion 48 is upwardly or axially outwardly bowed and is joined to the skirt 21 by a transition portion 51 and to the central panel portion 23 by a transition portion 52.

With reference to FIG. 10, when the closure cap 46 is drawn down onto the neck finish 17 of the container 15 which is packed at ambient pressure, the sealing surface 50 will generally conform to the sealing surface 20, but will be more tightly drawn down against the sealing surface 20 along the radially inner portion thereof due to the action of the skirt 21 and transition portion 51. The transition portion 52 will, of course, be partially effective to draw the sealing surface 50 down around the radially inner part of the sealing surface 20.

In FIG. 11, the same closure cap 46 is applied to the same container 15, but the container 15 is vacuum packed. The net effect of the pressure differential on the central panel portion 23 is to draw the central panel portion 23 down into the mouth or neck finish as is shown by way of a comparison of FIG. 11 with FIG. 10. The transition portion 52 further acts to draw the sealing portion 48 down and around to the interior of the container 15 more tightly to engage the sealing surface 50 with the sealing surface 20 and to increase the extent of the engaging surfaces radially inwardly.

It is to be understood that the closure caps 36 and 46 have all of the advantages described above with respect to the closure cap 16. It is also to be understood that each of the closure caps 16, 36 and 46 will have the sealing strip thereof deform to match the associated portions of the sealing surface 20 of the containers, notwithstanding any tilting or smooth irregularities thereof.

Although only one form of neck finish and associated terminal sealing surface has been illustrated with respect to the closure cap, it is to be understood that the invention is not so limited.

Referring now to FIG. 12, it will be seen that in FIG. 12*a* the rounded terminal sealing surface 53 is narrower then the sealing surface 20 and the neck finish has annular flats 54 on opposite sides thereof.

In FIG. 12*b* there is a terminal sealing surface 56 which slopes axially downwardly and radially outwardly from a radially inner curved portion 57, whereas in FIG. 12*c* the reverse sealing surface 58 is illustrated.

Although only several preferred embodiments of the closure cap have been specifically illustrated and described herein, it is to be understood that minor variations may be made in the closure cap without departing from the spirit and scope of the invention as defined by the appended claims.

I claim:

1. A closure cap for containers of the jar and bottle type having a terminal sealing surface rounded in transverse section, said closure cap being formed in one piece of a plastics material and comprising a skirt having securing means for retaining said skirt on a container in an axially tensioned state, and an end panel, said end panel including a central panel portion of a size to be aligned with an extension of an open end of an associated container and an integral annular deformable sealing strip connecting said central panel portion to said skirt, said sealing strip being thin as compared to said skirt, said sealing strip including an intermediate portion defining an annular sealing surface radially spaced from both said skirt and said central panel portion and being axially alignable with a container terminal sealing surface, and said sealing strip having a transition portion between said intermediate sealing strip portion and said skirt, said transition portion increasing in thickness toward said skirt and forming means for effecting a drawing of a radially outer part of said sealing surface down and around a radially outer part of a container rounded terminal sealing surface.

2. A closure cap according to claim 1 wherein said intermediate portion of said sealing strip is the least thick portion of said sealing strip.

3. A closure cap according to claim 1 wherein said intermediate portion is radially offset inwardly from the center of said sealing strip.

4. A closure cap according to claim 1 wherein said intermediate portion is of a uniform thickness.

5. A closure cap according to claim 1 wherein said central panel portion is a materially greater thickness than said intermediate portion of said sealing strip and said sealing strip has a second transition portion between said intermediate portion and said central panel portion, said second transition portion increasing in thickness toward said central panel portion.

6. The closure cap according to claim 5 wherein said second transition portion forms means for effecting a drawing of a radially inner part of said sealing surface down and around a radially inner part of a container rounded terminal sealing surface.

7. A closure cap according to claim 6 wherein said skirt is spaced from said sealing surface a distance great than the spacing between said sealing surface and said central panel portion.

8. A closure cap according to claim 1 wherein said sealing strip extends from the top of said skirt and said central panel portion has an under surface disposed above said skirt top.

9. A closure cap according to claim 1 wherein said central panel portion is thick as compared to said sealing strip and said sealing strip is joined to an axially inner or lower part of said central panel portion.

10. A closure cap according to claim 1 wherein said sealing strip is generally frustonconical and slopes radially inwardly and upwardly from said skirt.

11. A closure cap according to claim 1 wherein said sealing strip is arcuate in cross section and is bowed axially downwardly.

12. A closure cap according to claim 1 wherein said sealing strip is arcuate in cross section and is bowed axially downwardly and radially inwardly.

13. A closure cap according to claim 1 wherein said sealing strip is arcuate in cross section and is bowed axially upwardly.

14. A closure according to claim 1 wherein said closure cap is applied to a container in sealed engagement with a rounded terminal sealing surface of said container with said securing means drawing said skirt axially downwardly on said container relative to said terminal sealing surface and said transition portion causing a radially outer part of said closure sealing surface to conform to a like part of said terminal sealing surface and forming a seal therewith.

15. A closure according to claim 6 wherein said closure cap is applied to a container in sealed engagement with a rounded terminal sealing surface of said container with said securing means drawing said skirt axially downwardly on said container relative to said terminal sealing surface and said transition portion causing a radially outer part of said closure sealing surface to conform to a like part of said terminal sealing surface and forming a seal therewith.

16. The closure cap and container combination of claim 15 wherein said container is sealed under internal subatmospheric conditions, said central panel portion is drawn axially inwardly, and said second transition portion causing a radially outer part of said closure sealing surface to conform to a like part of said terminal sealing surface and engaging the area of said seal between said closure cap and said container.

* * * * *